United States Patent [19]

Luthi

[11] 4,265,740

[45] May 5, 1981

[54] CENTRIFUGAL SEPARATOR

[75] Inventor: Oscar Luthi, Nashua, N.H.

[73] Assignee: Ingersoll-Rand Company, Woodcliff Lake, N.J.

[21] Appl. No.: 104,541

[22] Filed: Dec. 17, 1979

[51] Int. Cl.[3] ..... B04C 5/103

[52] U.S. Cl. ..... 209/211; 210/512.1

[58] Field of Search ..... 209/144, 211; 210/512 R, 512 M; 55/304, 261, 338, 415, 416, 459 R

[56] References Cited

U.S. PATENT DOCUMENTS

| | | | |
|---|---|---|---|
| 2,638,181 | 5/1953 | Gordon | 209/144 |
| 3,040,888 | 6/1962 | Hosokawa et al. | 209/144 |
| 3,529,724 | 9/1970 | Maciula et al. | 209/211 X |
| 3,543,932 | 12/1970 | Rastatter | 209/211 |
| 3,848,550 | 11/1974 | Bowen | 55/338 X |
| 4,094,794 | 6/1978 | Kahmann | 209/144 X |

*Primary Examiner*—William A. Cuchlinski, Jr.
*Attorney, Agent, or Firm*—Frank S. Troidl

[57] ABSTRACT

The separator is particularly suitable for separating impurities from a pulp slurry. The separator includes a vertical vessel with an upper chamber and a lower chamber. The pulp slurry is fed into the upper chamber by means of a tangential pulp slurry inlet. A strong rotational movement is imparted to the pulp slurry in the upper chamber to cause the heavy impurities to move outwardly. Means are provided to change the strong rotational movement of the pulp slurry in the upper chamber to a primarily translational movement downwardly within the lower chamber so that the heavy impurities will move downwardly within the lower chamber. The heavy impurities are removed from the lower chamber.

5 Claims, 4 Drawing Figures

CENTRIFUGAL SEPARATOR

This invention relates to the pulp and paper industry. More particularly, this invention is a new separator for removing impurities from a pulp slurry.

In the processing of pulp for paper making, it is necessary to suspend the raw material in a liquid for the purpose of separating the individual wood fibers. This suspension or slurry contains impurities such as metal, glass, gravel, and sand which must be removed before the fibers can be refined to develop the proper characteristics required for paper making.

The present invention is directly concerned with the rapid and efficient removal of the impurities with a minimum of damage to the apparatus and to construct an apparatus occupying a minimum amount of space.

Briefly described, the separator includes a vertical vessel having an upper chamber and a lower chamber. The pulp slurry is fed tangentially into the vessel, at the top of the vessel to impart a strong rotational movement of the pulp slurry in the upper chamber to cause the heavy impurities to move outwardly. Means are also provided for changing the strong rotational movement of the pulp slurry in the upper chamber into a primarily translational movement downwardly within the lower chamber so that heavy impurities move downwardly within the lower chamber. The heavy impurities are removed from the lower chamber.

The invention, as well as its many advantages, may be further understood by reference to the following detailed description and drawings in which.

In the various figures, like parts are referred to by like numbers.

Figure 1:
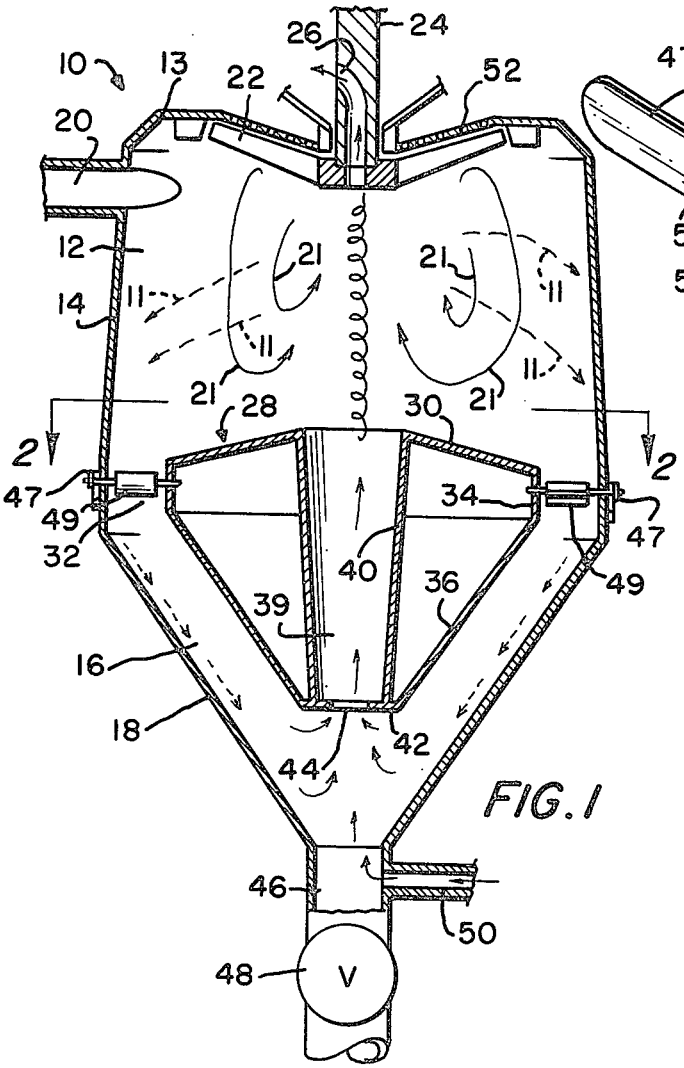
FIG. 1 is an elevational view, partly in section, illustrating one preferred embodiment of my invention.
Figure 2:
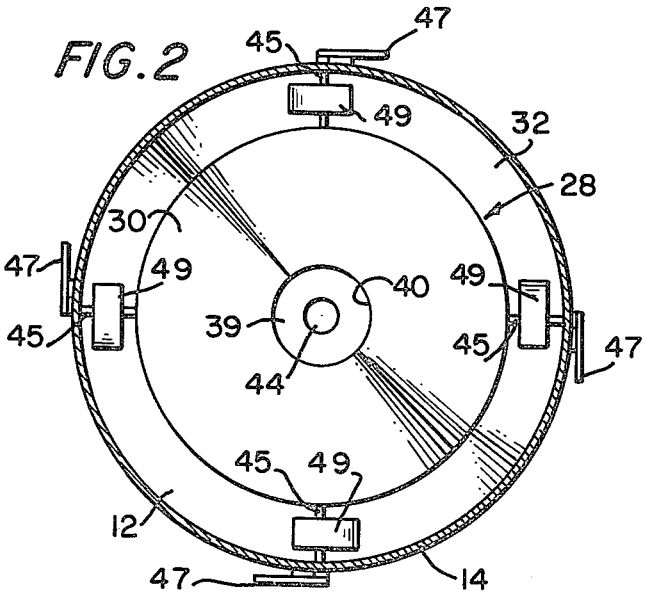
FIG. 2 is a view taken along lines 2—2 of FIG. 1 and in the direction of the arrows.

Referring to the drawings, and more particularly to FIG. 1 and FIG. 2, the new separator 10 comprises a vertical vessel having an upper chamber 12 formed by the top 13 of the vessel and an upwardly tapering annular wall 14, and a lower chamber 16 formed by a downwardly tapering annular chamber wall 18 extending downwardly from annular wall 14.

The pulp slurry is fed into upper chamber 12 by means of a tangential pulp slurry inlet 20. A primary circulation indicated by arrows 21 is superimposed on the tangential movement of the pulp slurry as the pulp slurry enters the upper chamber 12 due to the rotation of rotor 22 connected to the rotatable shaft 24 containing a conduit 26. Rotor 22 rotates in the same direction as the tangential movement of the pulp slurry.

A conical body, generally indicated by the number 28, is mounted coaxially within the vessel 10. The conical body 28 includes an annular top 30 and a downwardly extending cylindrical wall 34 located within the vessel 10 near the junction of annular walls 14 and 18, and a downwardly tapering conical wall 36 connected to the base of cylindrical wall 34 with its lower end connected to disc 42 with central aperture 44. The outside diameter of wall 34 is smaller than the inside diameter of wall 14, thus providing an annular passage 32 (see FIG. 2) between the cylindrical wall 34 and the wall 14.

The diameter of cylindrical wall 34 is sufficiently less than the inside diameter of wall 14 to permit big pieces of metal to pass downwardly within the annular space 32.

Conical body 28 is mounted to the inside of wall 14 of the vessel 10 by four supports circumferentially spaced by 90° angles. If desired, one or more of the supports may be made adjustable about an axis extending radially from the axis of the vessel 10.

Figure 3:
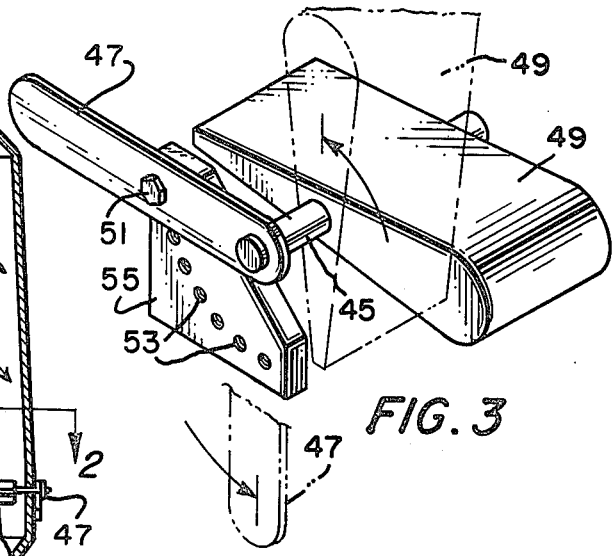
FIG. 3 is a perspective view, on an enlarged scale, showing the details of the adjustable supports.

FIG. 3 illustrates a mechanism for adjusting the supports. Each support includes a rotatable rod 45 with one end mounted in cylindrical wall 34 and the other end extending radially through wall 14 and is connected to one end of handle 47. The supports are shaped to change the rotational movement in the upper chamber to a primarily translational movement in the lower chamber. For that purpose, in the embodiment of FIGS. 1 through 3, a wedge 49 is integral with rod 45. The angular position of the wedge 49 is adjustable by removing the bolt 51, turning the handle 47 and inserting the bolt 51 into another hole 53 formed through plate 55 mounted to the outside of wall 14.

Conical body 28 also includes a centrally located recirculation conduit 39 formed by a downwardly slightly tapered annular wall 40. The bottom of downwardly tapering wall 40 is connected to disc 42 containing central aperture 44. Disc 42 is located at a point in the chamber 16 spaced from the bottom of chamber 16.

The bottom of annular wall 18 is connected to a conduit 46 controlled by valve 48, for conducting the heavy impurities from the bottom of chamber 16. Elutriation water inlet 50 is connected to the conduit 46 for introducing a small amount of elutriation water into the vessel to wash pulp fibers from the heavy impurities and to prevent pulp fibers from settling in the conduit 46. The pulp slurry, free of heavy impurities, flows upwardly through aperture 44 in disc 42, and upwardly through the annular conduit 39, and into upper chamber 12. Accumulated heavy impurities are periodically discharged through valve 48.

An annular perforated screen 52 is provided in the top 13 of the vessel 10. The stock suspension which has filled the vessel 10 is discharged through the perforated screen 52 into a chamber (not shown) for removal of the desired wood fiber.

In operation, a stock suspension enters the vessel through the tangential pipe 20 located near the top of the upper chamber 12 in the same direction as the rotation of the rotor 22. The stock suspension fills the vessel and desired fibers discharge through the perforated screen 52 at the top end of the vessel into a chamber fitted with a pipe for removal of the accepted fibers. Rotor 22 imparts a rotation to the stock suspension in the upper compartment 12. A primary circulation is superimposed on the rotation of the stock suspension by the pumping action of the rotor 22. Heavy impurities entering the vessel 10 with the stock suspension are subjected to the action of centrifugal force as they rotate with the mass and move to the circumferential wall 14, as indicated by arrows 11. The heavy impurities are carried downward by the spirally downward flow near the wall, the action of gravity, and the downward component of reaction to centrifugal force exerted on the heavy impurities by the upwardly tapering circumferential wall 14.

A rotating layer of stock suspension adjacent to the annular wall 14, rich in heavy impurities, impinges upon the radial supports. The impingement stops the rotation of the layer and deflects it into the lower compartment. The primarily rotational movement in the upper chamber 12 is changed by the impingement on the supports into a primarily translational movement as the material including the impurities flows downwardly into the lower chamber 16.

The remainder of the rotating stock suspension is excluded from the lower chamber 16 by the top surface 30 of conical body 28 and flows toward the axis in the form of a free spiral vortex, then upward due to the pumping action of the rotor 22. The stock suspension in the lower chamber 16, having little or no rotation, flows axially downward. Heavy impurities concentrated near the circumferential wall 18 of the lower chamber 16 follow the axial downward flow of the stock suspension and are assisted by gravity in settling toward the bottom and into the conduit 46. A small amount of elutriation water is introduced into conduit 46 by means of elutriation water inlet 50 to wash the heavy impurities free of pulp fibers to enhance the separation of small heavy impurities and prevent pulp fibers from settling.

The stock suspension, free of heavy impurities, reverses its downward axial flow and flows upward, along with the elutriation water, through aperture 44 in disc 42, and recirculation conduit 39 toward the upper chamber 12. The size of the aperture 44 controls the flow of the stock suspension free of heavy impurities. A secondary circulation is established in the lower chamber 16 below the disc 42. The magnitude of this secondary circulation is controlled by the size of aperture 44. This secondary flow prevents the pulp from thickening up by settling, and plugging up the tramp metal discharge.

The light impurities are removed at the uppermost part of the upper chamber 12 through the conduit 26 in shaft 24 of rotor 22.

Figure 4:
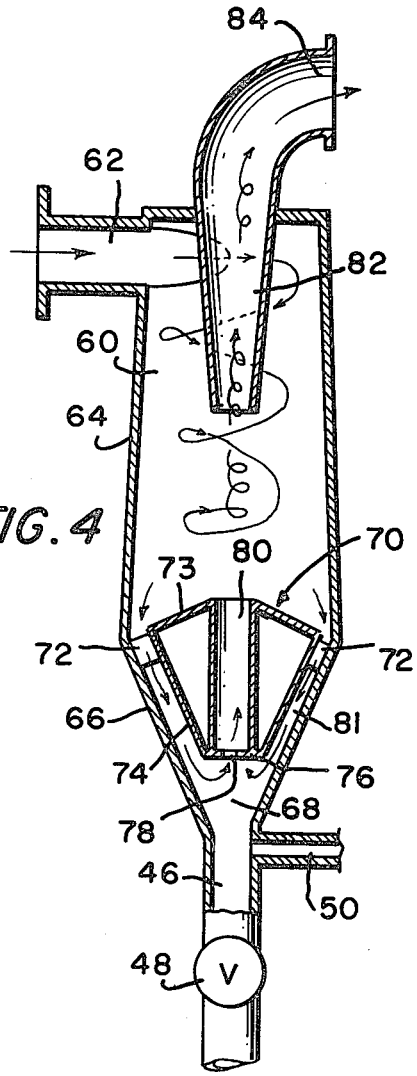
FIG. 4 is an elevational view, partly in section, of a second preferred embodiment of the invention.

In the embodiment shown in FIG. 4, the pulp slurry is fed into the upper chamber 60 by means of the tangential stock inlet 62 and a strong rotational movement is imparted to the stock. The annular wall 64 of the vessel tapers upwardly and is connected to the top of a downwardly tapering wall 66 which forms the lower chamber 68.

The conical body 70 is mounted within the vessel near the junction of walls 64 and 66 by means of the rib supports 72. The rib supports 72 are shown in the embodiment of FIG. 4 as fixed; however, they could be made adjustable as is the case with the supports of the embodiment of FIGS. 1 through 3. The conical body includes the annular top 73, and the conical wall 74 tapering downwardly from top 73 to the disc 76 with its centrally located aperture 78. The centrally located aperture 78 controls the secondary re-circulation in the chamber 68 below the disc 76 and controls the flow of the pulp slurry, free of impurities, upwardly within the recirculation conduit 80 and into the upper chamber 60.

The operation of the embodiment of FIG. 4 is substantially the same as the operation of the embodiment of FIGS. 1 and 3. Briefly, the pulp slurry is fed into the upper chamber 60, the heavy impurities flow downwardly in the annular channel 81, formed by wall 66 and wall 74. The impurities which are removed through conduit 46 have the fibers removed therefrom by the elutriation water fed through line 50 and the pulp slurry free of impurities, flows upwardly through conical member 82 and out of the accepts outlet 84.

I claim:

1. A separator for removing impurities from a pulp slurry comprising: a vertical vessel having an upper chamber and a lower chamber; means for feeding a pulp slurry tangentially into the upper chamber to impart a rotational movement to the pulp slurry to cause the impurities to move outwardly; a recirculation conduit coaxially mounted in the vessel; means for changing the rotational movement of the pulp slurry in the upper chamber into a primarily translational movement downwardly within the lower chamber so that impurities move downwardly within the lower chamber; an elutriation water inlet located to flow elutriation water into the lower chamber to wash pulp fibers from the impurities and flow the pulp slurry, free of impurities, upwardly with the recirculation conduit and into the upper chamber; and means for removing the impurities from the lower chamber.

2. A separator in accordance with claim 1 wherein a coaxial rotor is in the upper chamber.

3. A separator in accordance with claim 1 wherein the means for changing the rotational movement of the pulp slurry in the upper chamber into a primarily translational movement downwardly within the lower chamber comprises: a member mounted concentrically within the vessel, the top of the member being generally located in the area where the upper chamber and the lower chamber are connected, the outer radial edge of the member having a diameter sufficiently smaller than the inside diameter of the vessel to permit big pieces of metal to pass and to provide an annular passage between the member and the inside wall of the vessel, said member being mounted to the vessel by a plurality of circumferentially spaced supports extending from said member to the inside wall of the vessel, said supports being shaped to change the rotational movement in the upper chamber to a primarily translational movement in the lower chamber.

4. A separator for removing impurities from a pulp slurry comprising: a vertical vessel having an upper chamber and a lower chamber, the lower chamber being formed by a downwardly tapering portion of the vessel connected to the bottom of the upper chamber; means for feeding a pulp slurry tangentially into the upper chamber to impart a rotational movement to the pulp slurry and to cause the impurities to move outwardly; a conical body mounted coaxially within the vessel, and generally located in the area where the upper chamber and the lower chamber are connected, the outer radial edge of the conical body having a diameter smaller than the inside diameter of the vessel thereby providing an annular passage between the conical body and the inside wall of the vessel, said conical body being mounted to the vessel by a plurality of circumferentially spaced supports extending from the conical body to the inside wall of the vessel said supports being shaped to change the rotational movement in the upper chamber to a primarily translational movement in the lower chamber; a coaxial recirculation conduit extending downwardly from the top of the conical body to a point above the bottom of the vessel; an elutriation water inlet located below the bottom of the vessel for flowing elutriation water into the vessel to wash pulp fibers from the impurities and flow the pulp slurry, free of impurities, upwardly within the recirculation conduit and into the upper chamber; and means for removing the impurities from the lower chamber.

5. A separator in accordance with claim 4 wherein a control aperture is provided on the recirculation conduit to establish a secondary circulation in the lower chamber below the recirculation conduit.

* * * * *